US006345797B1

(12) United States Patent
Ming-Hsiao

(10) Patent No.: US 6,345,797 B1
(45) Date of Patent: Feb. 12, 2002

(54) ROLLING TOILET PAPER RACK

(76) Inventor: Lai Ming-Hsiao, 8-26, Lane 2, Kung Chi Village, Ta Tsuen Hsiang, Chang-Hua Hsien (TW)

( * ) Notice: Subject to any disclaimer, the term of this patent is extended or adjusted under 35 U.S.C. 154(b) by 0 days.

(21) Appl. No.: 09/591,048

(22) Filed: Jun. 9, 2000

(51) Int. Cl.[7] ..... A47F 5/00; B65H 16/06

(52) U.S. Cl. ..... 248/309.2; 248/251; 211/105.1; 242/598.3

(58) Field of Search ..... 248/309.1, 309.2, 248/303, 304, 251, 261–262, 254; 211/119.009, 105.1–105.6, 87.01, 123, 85.5, 6, 16, 88.04; 4/559, 576.1, 577.1; D6/524, 536, 540, 546, 548–550; 242/597.6, 597.7, 597.8, 598–598.4, 598.5, 592, 590, 596, 599–599.4, 570, 578, 578.2

(56) References Cited

U.S. PATENT DOCUMENTS

| | | | | | |
|---|---|---|---|---|---|
| 261,817 | A | * | 7/1882 | Mallory | 211/105.6 |
| 477,144 | A | * | 6/1892 | Neidhart | 248/309.2 |
| 1,310,019 | A | * | 7/1919 | Hosfeldt | 242/598.3 |
| 1,391,326 | A | * | 9/1921 | Killian | 242/598 |
| 1,772,917 | A | * | 8/1930 | Sifferman | 242/598 |
| 1,800,030 | A | * | 4/1931 | Reynolds | 211/123 |
| 2,308,168 | A | * | 1/1943 | Garson | 242/598.3 |
| 2,466,957 | A | * | 4/1949 | Lewis | 242/598.1 |
| 2,617,537 | A | * | 11/1952 | Henley | 248/251 |
| 2,858,995 | A | * | 11/1958 | Sarro | 242/55.3 |
| 3,834,636 | A | * | 9/1974 | Linick | 242/55.2 |
| 4,378,071 | A | * | 3/1983 | Yakimicki | 211/105.4 |
| 4,991,724 | A | * | 2/1991 | Wei | 211/87.01 |
| D317,386 | S | * | 6/1991 | McKeone | D6/524 |
| 5,186,427 | A | * | 2/1993 | Semchuck | 248/251 |
| 5,374,008 | A | * | 12/1994 | Halvorson et al. | 242/598.3 |
| 5,458,310 | A | * | 10/1995 | Johnson | 248/251 |
| 5,623,880 | A | * | 4/1997 | Kuntz | 242/598.1 |
| 5,642,462 | A | * | 6/1997 | Huff | 248/251 |
| 5,718,404 | A | * | 2/1998 | Greer | 248/309.2 |
| 5,810,180 | A | * | 9/1998 | Chan | 248/251 |
| 5,875,903 | A | * | 3/1999 | Chen | 211/105.1 |
| 5,904,329 | A | * | 5/1999 | Kanome et al. | 248/309.2 |
| 5,931,427 | A | * | 8/1999 | Pan | 248/251 |
| 6,024,231 | A | * | 2/2000 | Bates | 211/105.1 |
| 6,131,213 | A | * | 10/2000 | Sarff | 211/105.1 |
| 6,220,460 | B1 | * | 4/2001 | Pan | 211/87.01 |
| 6,231,000 | B1 | * | 5/2001 | Wood | D6/521 |

* cited by examiner

*Primary Examiner*—Daniel P. Stodola
*Assistant Examiner*—Jennifer E. Novosad
(74) *Attorney, Agent, or Firm*—Harrison & Egbert

(57) ABSTRACT

A rack including a U-shaped rack, two locating seats, two bases and an extension rod. Two locating seats are respectively put through the two side rods of the U-shaped rack. Two bases are respectively fastened to the ends of the side rods to fix the U-shaped rack on the wall. The two locating seats are fixed on the side rods by screws and provided with pivoting holes respectively, on which the extension rod is mounted parallel to the front horizontal rod of the U-shaped rack at proper distances so as to make the rolling toilet paper be put through the extension rod and disposed between the two side rods. By leaning upon the front horizontal rod of the U-shaped rack, the toilet paper can be torn easily.

1 Claim, 5 Drawing Sheets

ROLLING TOILET PAPER RACK

BACKGROUND OF THE INVENTION

The present invention relates generally to a rack, and more particularly to a roller toilet paper rack.

DESCRIPTION OF RELATED ART

As shown in FIG. 1, a prior art rolling toilet paper rack 10 is made by a C -shaped rod 11. The toilet paper 1 can be put through the bottom horizontal rod 111 of the C -shaped rack 11 and be hung on it. Although the rolling toilet paper 1 can roll on the bottom horizontal rod 111 and can be pulled out smoothly, the user needs to hold the rolling toilet paper 1 by one hand while he or she pulls the rolling toilet paper 1 out and tears it by the other hand. As a result, the rolling toilet paper rack 10 of the prior art is not convenient to use.

BRIEF SUMMARY OF THE INVENTION

The primary objective of the present invention is therefore to provide an improved rolling toilet paper rack by which the toilet paper can be torn by one hand without holding it by the other hand.

It is another objective of the present invention to provide a rolling toilet paper rack with an extension rod which will not fall off easily while the users disassemble and reassemble the toilet paper from and on it.

In keeping with the principle of the present invention, the foregoing objectives of the present invention are attained by a rack consisting of a U-shaped rack, two locating seats, two bases and an extension rod. Two locating seats are put through the two side rods of the U-shaped rack. Two ends of the extension rod are respectively mounted to the locating seats of the two side rods parallel to the front horizontal rod of the U-shaped rack at proper distances so as to mount the roller toilet paper through the extension rod and between the two side rods. By leaning upon the front horizontal rod of the U-shaped rack, the roller toilet paper can be torn easily.

The objective, features, functions, and advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
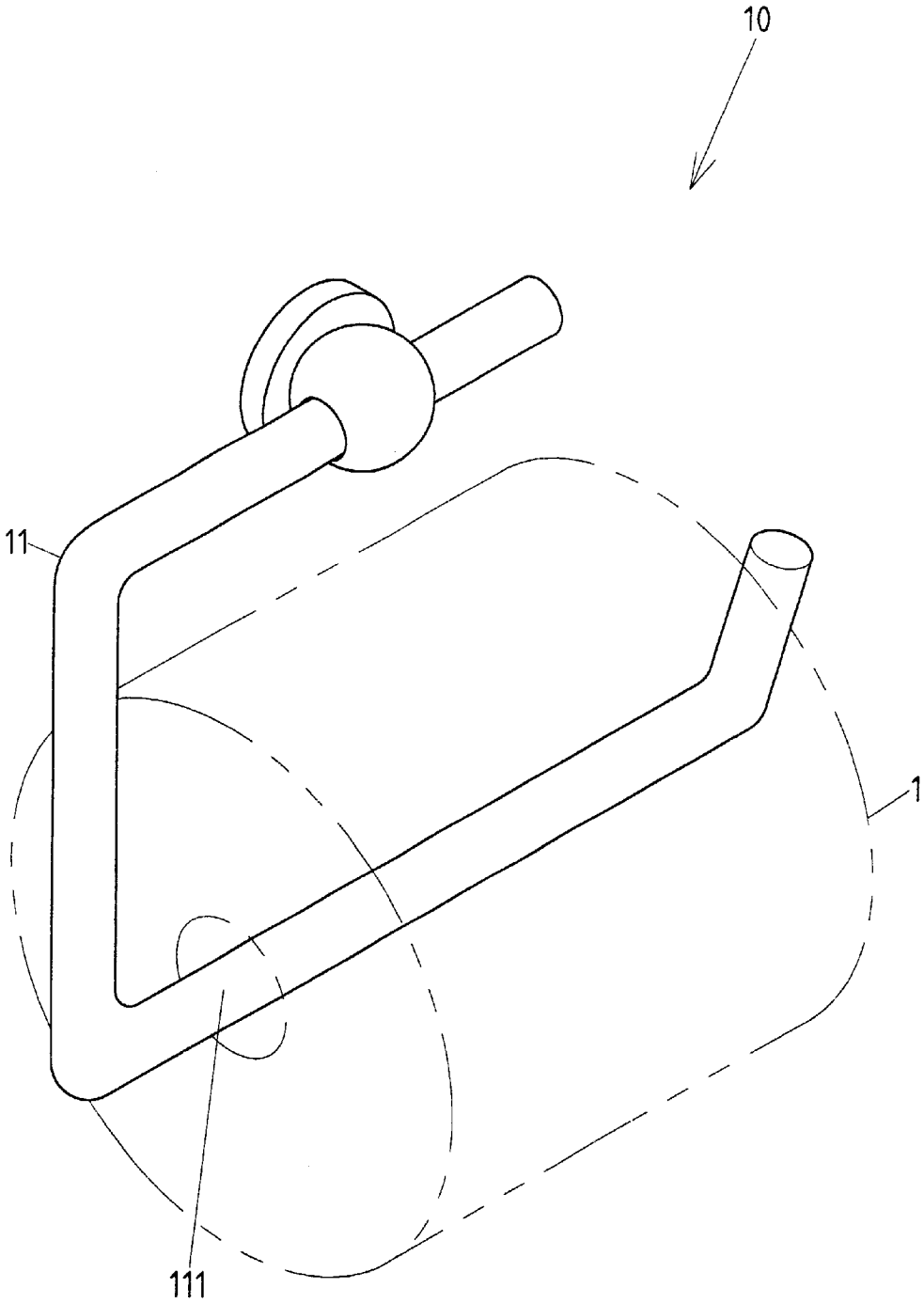
FIG.1 PRIOR ART
FIG. 1 shows a perspective view of a prior art rolling toilet paper rack.
Figure 2:
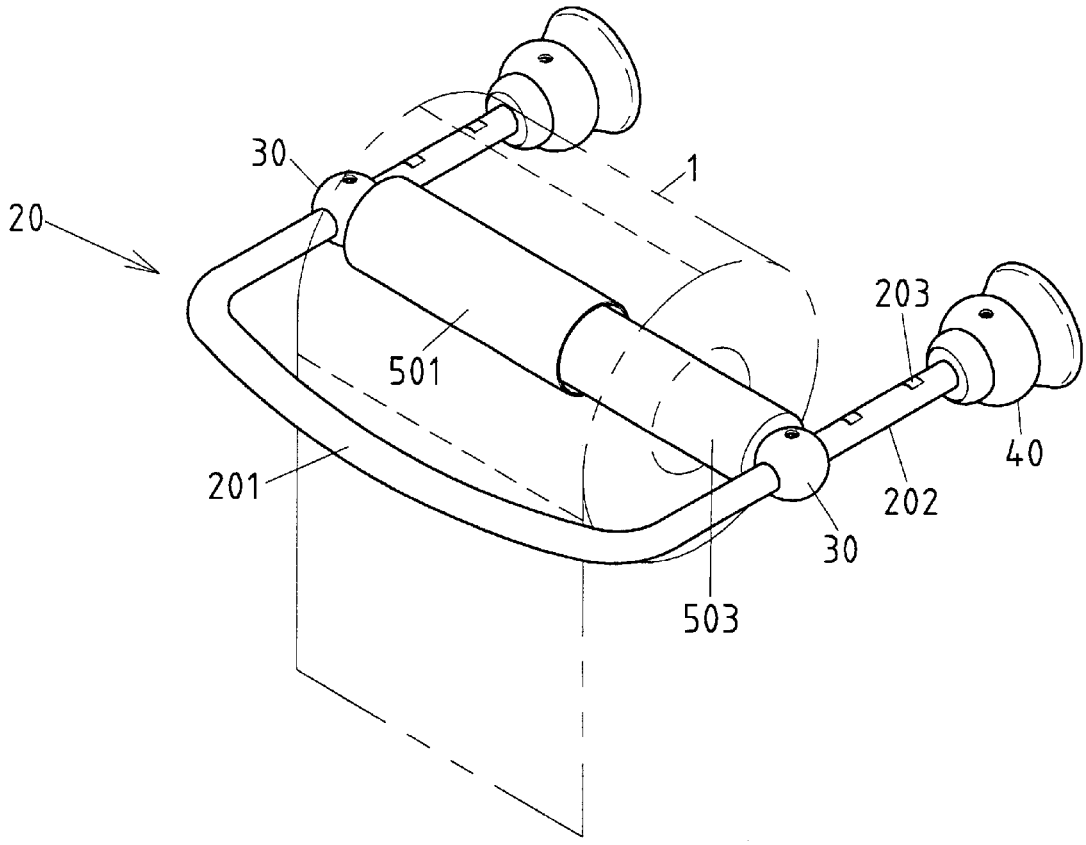
FIG. 2 shows a perspective view of a rolling toilet paper rack of the preferred embodiment of the present invention.
Figure 3:
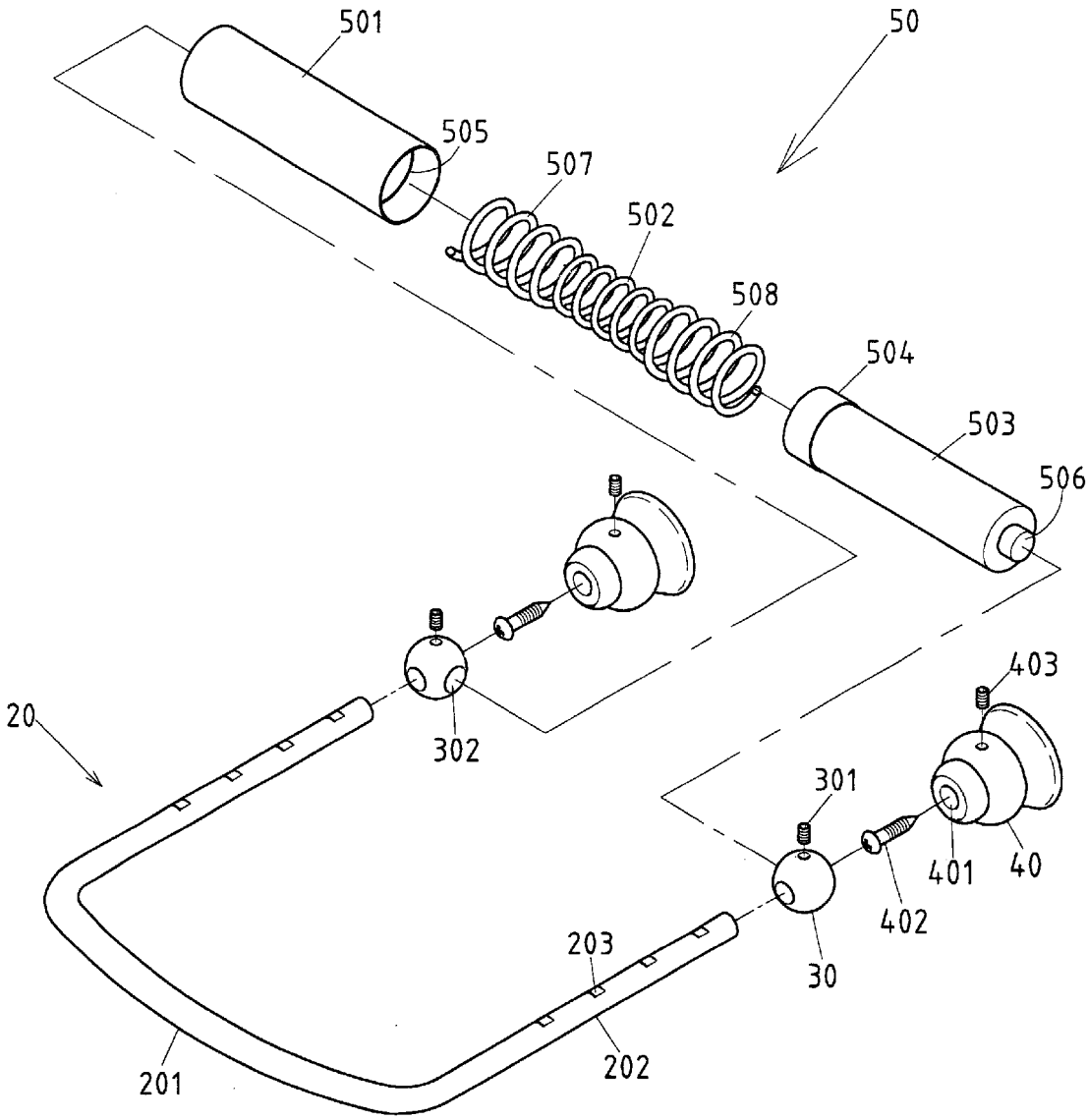
FIG. 3 shows an exploded view of the rolling toilet paper rack of the preferred embodiment of the present invention.
Figure 5:
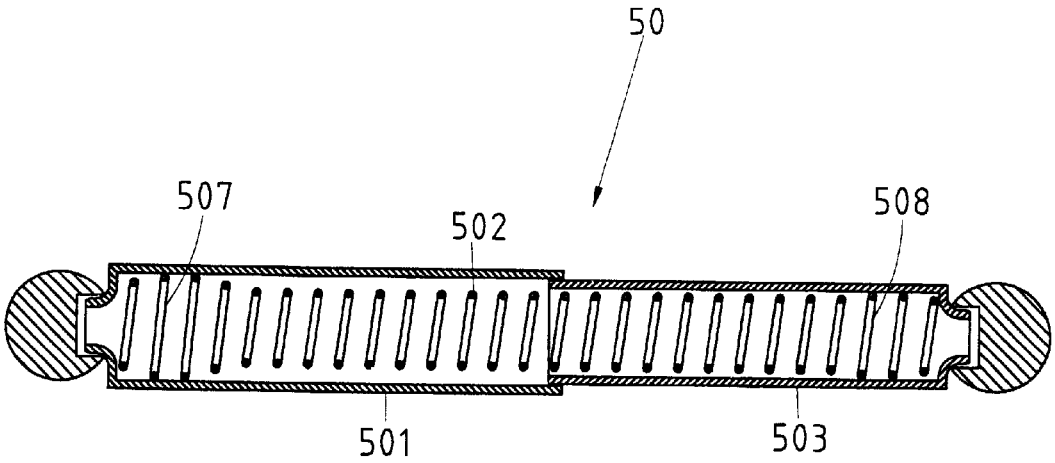
FIG. 5 shows a sectional view of the extension rod of the preferred embodiment of the present invention.

As shown in FIGS. 2, 3, and 5, a rolling toilet paper rack embodied in the present invention comprises a U-shaped rack, two locating seats, two bases and an extension rod, which are described explicitly hereinafter.

Two ends of the front horizontal rod 201 of a U-shaped rack 20 are bent in the same direction extending to form two parallel side rods 202. On the proper positions of the two parallel side rods 202 are provided with a plurality of locating planes 203 which are set on top or bottom surfaces of the two parallel side rods 202.

Two locating seats 30 are respectively put through two side rods 202 to about mid-section and fastened on the locating plate 203 of the side rods 202 to fix the two locating seats 30 on the two side rods 202 relatively. Each opposite aspect of the two locating seats 30 has a pivoting hole 302.

Each of the two bases 40 with each has a through hole 401 in the middle for driving through screws 402 to fix the two bases 40 on the wall. The ends of the two side rods 202 of the U-shaped rack 20 are inserted into the inside of through holes 401 of the two bases 40 and two screws 403 are respectively screwed to the locating planes 203 of the two side rods 202 longitudinally from the round surface of the two bases 40 to fasten the U-shaped rack 20 on the two bases.

An extension rod 50 is composed of a parent tube 501, a spring 502 and a daughter tube 503. The spring 502 is disposed inside of the parent tube 501 and the daughter tube 503 is inserted following the spring 502 so that the daughter tube 503 can stretch out the end of the parent tube 501 due to the elasticity of the spring 502 in normal conditions. By wedging a convex ring 504 of outer wall of the end of the daughter tube 503 with a convex circle 505 of inner wall of the end of the parent tube 501, the two tubes can be connected. Each end of the extension rod 50 respectively forms a protruded pillar 506 to be respectively inserted into the two pivoting holes 302 of the locating seats 30 and to keep the extension rod 50 parallel to the front horizontal rod 201 of the U-shaped rack 20 at proper distances. The two ends of the spring 502 respectively form two enlarged outer diameters 507 and 508 to be respectively inserted into the parent tube 501 and daughter tube 503 to make the spring 502 be stuck on the inner wall of the parent tube 501 and daughter tube 503 due to the enlargement effect.

Figure 4:
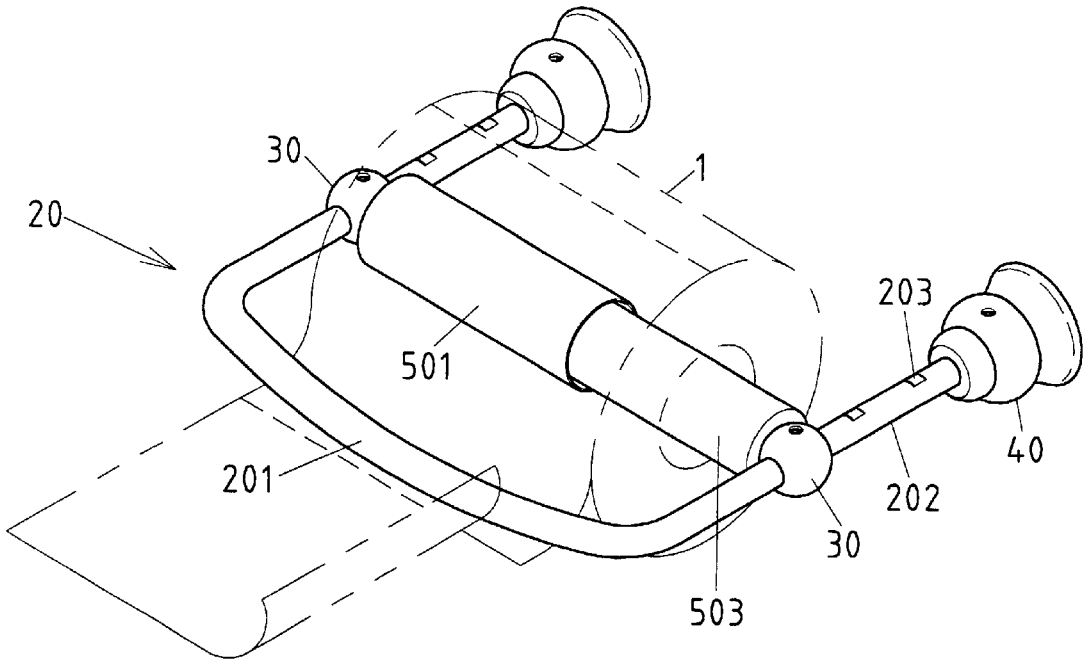
FIG. 4 shows a schematic view of the rolling toilet paper rack of the preferred embodiment of the present invention.

As shown in FIGS. 3 and 4, the present invention achieves many advantages over the prior art. In the present invention, the extension rod 50 of the rolling toilet paper rack can be inserted into the inside of the toiler paper 1 and be mounted between the two locating seats 30. The toilet paper 1 is pulled out and torn smoothly from the bottom of the front horizontal 201 of the U-shaped rack 20 by utilizing the extension rod 50 as a central pivot.

Two locating seats 30 can be adjusted to forward or backward position by loosening the screws 301 so as to adjust the distance between the extension rod 50 and the front horizontal rod 210 to meet with various sizes of toilet papers.

Finally, as shown in FIG. 5, the parent tube 501 and the daughter tube 503 of the inventive extension rod 50 are connected by enlargement effect caused by enlarged outer diameters 507 and 508 of two ends of the spring 502 stuck on the inner wall of the parent tube 501 and daughter tube 503. As a result, due to the fixed effect of two ends of the spring 502, the parent tube 501 and daughter tube 503 will not fall off because of elasticity. As such, the extension rod 50 of the present invention, during the process of disassembling and reassembling it from and on the U-shaped rack 20 and putting articles through it, will not fall off to achieve the goal of convenience in using.

The embodiment of the present invention described above is to be regarded in all respects as being merely illustrative and not restrictive. Accordingly, the present invention may be embodied in other specific forms without deviating from the spirit thereof. The present invention is therefore to be limited only by the scope of the following appended claim.

I claim:

1. A toilet paper rack comprising:

a U-shaped rack having a front horizontal rod and a first side rod and a second side rod, said first and second side rods being bent from said front horizontal rod and extending in the same direction therefrom parallel to each other, each of said first and second side rods having a plurality of locating planes formed on at least one of a top and a bottom thereof;

a first locating seat extending over said first side rod and located at a middle section of said first side rod, said first locating seat having a pivoting hole;

a first screw received by said first locating seat and fixed against one of said plurality of locating planes on said first side rod;

a second locating seat extending over said second side rod and located at a middle section of said second side rod, said second locating seat having a pivoting hole facing said pivoting hole of said first locating seat;

a second screw received by said second locating seat and fixed against one of said plurality of locating planes on said second side rod;

a first base having a through hole in a middle thereof, said through hole suitable for receiving a member therein for securing said first base to a wall, said first side rod having an end inserted into said through hole;

a third screw received by said first base so as to fix against another of said locating planes of said first side rod;

a second base having a through hole in a middle thereof, said through hole of said second base suitable for receiving another member therein for securing said second base to a wall, said second side rod having an end inserted into said through hole;

a fourth screw received by said second base so as to fix against another of said locating planes of said second side rod; and an extension tube having a parent tube and a spring and a daughter tube, said spring disposed within said parent tube and within said daughter tube, said daughter tube extending outwardly of said parent tube, said parent tube having a convex circular area on an inner wall at an end of said parent tube, said daughter tube having a convex ring on an outer wall at an end of said daughter tube, said convex ring being wedged within said convex circular area, one end of said extension tube having a first protruding pillar extending therefrom, another end of said extension tube having a second protruding pillar extending therefrom, said first protruding pillar received within said pivoting hole of said first locating seat, said second protruding pillar received within said pivoting hole of said second locating seat, said extension tube being in parallel spaced relationship to said front horizontal rod of said rack, said spring having a first end with an enlarged diameter stuck against said inner wall of said parent tube, said spring having a second end with an enlarged diameter stuck against an inner wall of said daughter tube.

* * * * *